United States Patent [19]

Boucard

[11] 4,112,722

[45] Sep. 12, 1978

[54] COLD PROFILING MACHINE

[75] Inventor: Michel Jean Boucard, Fontenay-le-Fleury, France

[73] Assignee: Societe Industrielle et Financiere le Profil, Saint-Cloud, France

[21] Appl. No.: 820,012

[22] Filed: Jul. 28, 1977

[30] Foreign Application Priority Data

Feb. 14, 1977 [FR] France ..... 77 04066

[51] Int. Cl.[2] ..... B21D 5/08

[52] U.S. Cl. ..... 72/181; 72/249

[58] Field of Search ..... 72/181, 249, 176

[56] References Cited

U.S. PATENT DOCUMENTS

| | | | |
|---|---|---|---|
| 3,006,224 | 10/1961 | Celovsky | 72/249 |
| 3,559,431 | 2/1971 | Noe et al. | 72/8 X |

*Primary Examiner*—Milton S. Mehr

[57] ABSTRACT

The machine comprises a succession of heads each provided with two superimposed rolls and arranged in alignment one behind the other. One of the roll support shafts of each head is connected to a particular hydraulic drive motor and is connected to rotate with the corresponding shaft of each one of the adjacent heads through a connection which is capable of being disconnected. All the motors are connected to the same source of fluid under pressure.

In a preferred embodiment, in each head the shaft connected to the motor carries a notched pulley and is connected with the corresponding shaft of each of the adjacent heads by a notched belt engaged with the pulley it carries and with the pulley of the corresponding shaft.

5 Claims, 2 Drawing Figures

COLD PROFILING MACHINE

Figure 1:
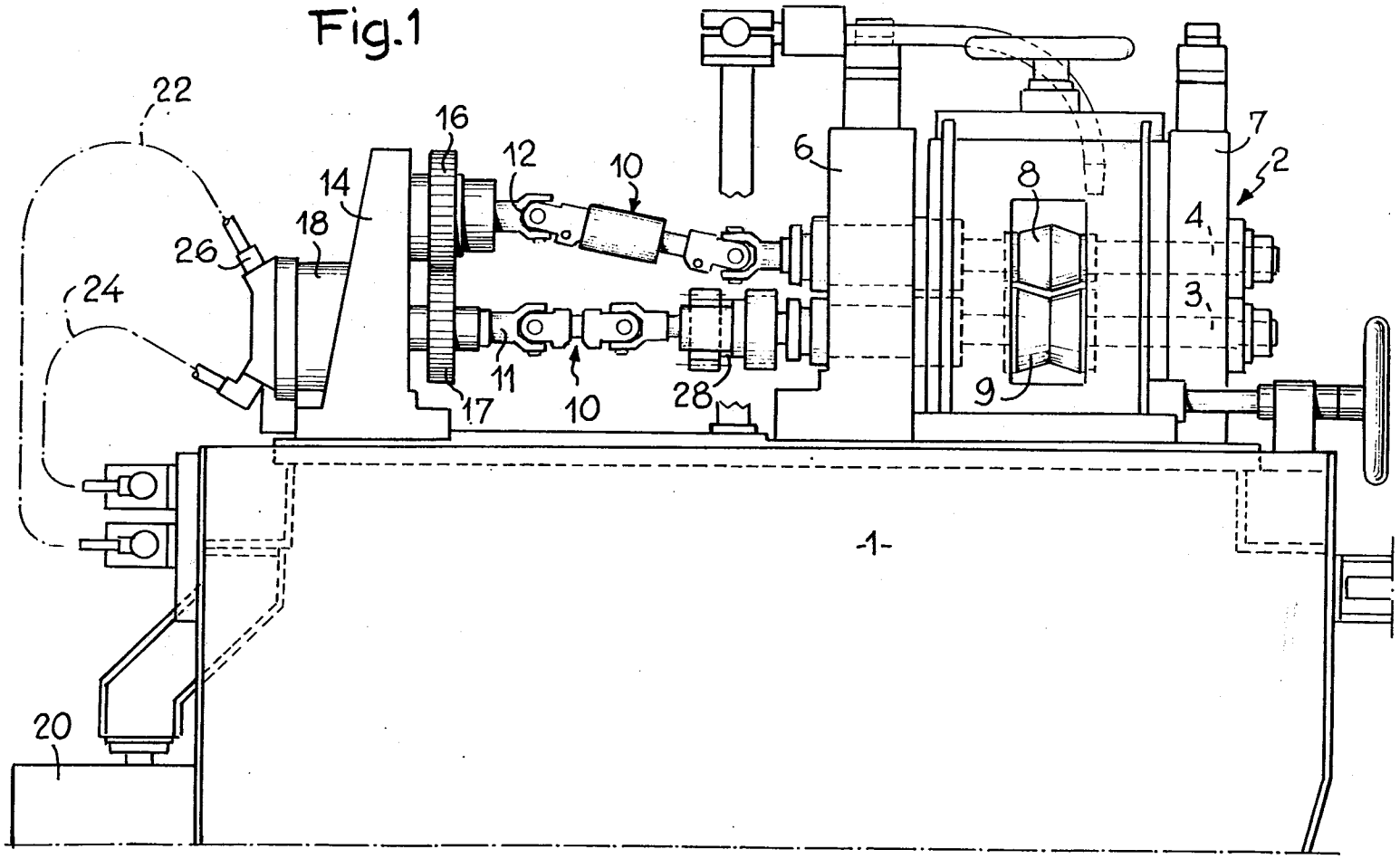

Profiling machines effecting a cold deformation of a metal band or ribbon usually comprise a succession of heads each provided with two superimposed rolls and aligned one behind the other, the rolls of the successive heads having different profiles so as to achieve a progressive deformation of the metal. The number of heads is variable and depends on the complexity of the profile or shape to be produced. Indeed, the more the section of a metal shape has changes in direction the more it requires a folding of the metal and the higher the number of profiling heads required.

In machines of this type, the rolls are driven by an electric motor which drives a shaft disposed parallel to the direction of displacement of the metal and connected through a system of gears to one of the two shafts supporting the rolls of each head. The machine is intended for a particular type of shape and its adaptation to other shapes not only requires the replacement of the rolls, which is a conventional and simple operation, but also a disassembly and a modification of the drive device, which necessitates immobilising the machine during a relatively long period.

Moreover, the production of metal shapes of different qualities or different thicknesses can also require a modification of the power of the motor and/or of the speed of the rolls, a defect in the setting of these elements being liable to result in breakage of the rolls under the effect of an excessive force.

An object of the present invention is to overcome these drawbacks and to provide a profiling machine employing a cold deformation wherein one of the shafts supporting the rolls of each head for profiling is connected to a distinct hydraulic drive motor and is connected to rotate with the corresponding shaft of each of the adjacent heads through a connection which is capable of being disconnected, all the motors being connected to the same source of fluid under pressure.

According to a preferred embodiment, in each head the shaft connected to the motor carries a notched pulley and is connected to the corresponding shaft of each of the adjacent heads through a notched belt engaged with the pulley that it carries and with the pulley of the corresponding shaft.

Such a machine can be easily adapted to the production of metal shapes or profiled members of different qualities and variable thicknesses, since the number of heads in service can be easily modified by varying the number of hydraulic motors in communication with the common source of fluid under pressure and by disconnecting or reconnecting one of the notched belts connecting the roll support shafts. Moreover, very small and easily progressive variations in speed can be obtained by a simple regulation of the supply of the motors. The machine furthermore has very high safety against any incident and avoids danger of breakage of the rolls.

The ensuing description of one embodiment given by way of a non-limitative example and shown in the accompanying drawings will bring out advantages and features of the invention.

Figure 2:
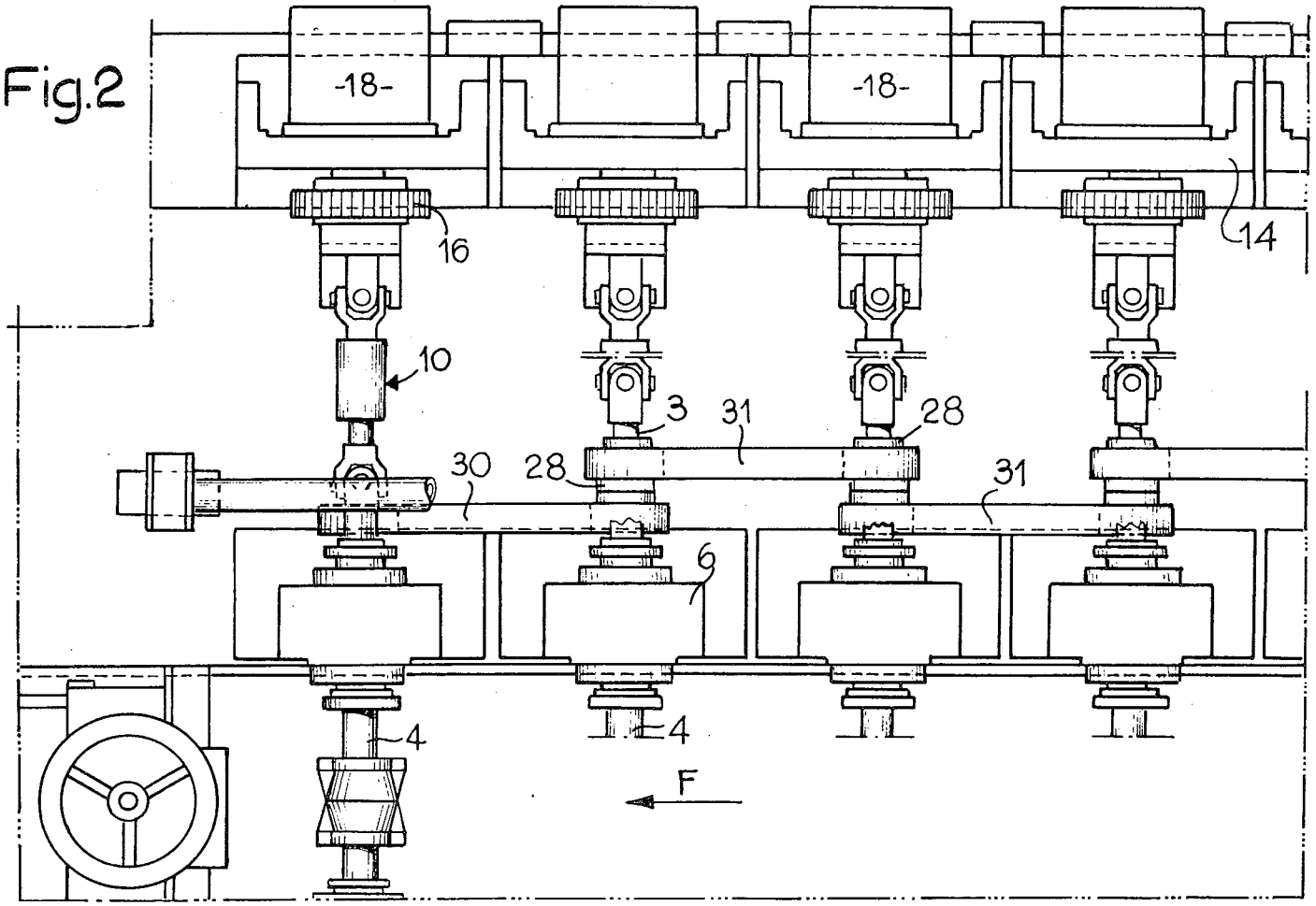

In the drawings:

FIG. 1 is a side elevational view of a cold profiling machine according to the invention, and FIG. 2 is a partial top plan view of this machine with a part cut away.

The profiling machine employing a cold deformation shown in the drawings is a roll-type machine comprising on a frame 1 a series of profiling heads 2 aligned one behind the other. In each of these heads two superimposed shafts 3 and 4 are supported at one end by a support 6 secured to the frame 1 and at their other end in a support 7 capable of sliding with respect to the frame 1 in a direction parallel to the axis of the shafts 3 and 4. Two rolls 8 and 9 of complementary shapes are respectively mounted on the shafts 4 and 3, the shape of these rolls depending of course on the profile or shape to be produced and varying from one head to another.

Each of the shafts 3 and 4 extends fully through the fixed supports 6 and is connected, on the side of the latter opposed to the roll 8, 9, through a cardan joint system 10 to a drive shaft respectively 11 and 12, the two drive shafts being supported by a common vertical metal frame 14 secured to the main frame of the machine.

The lower shaft 3 of the head 2 is mounted in a bearing fixed in the support 6 and the upper shaft 4 is mounted in a bearing which is slidable inside this support 6 so that the distance between the two rolls 8 and 9 can be modified and the outside dimensions of these rolls can also be modified. The shafts 11 and 12 have a position which is fixed with respect to the frame 14. They are interconnected by two gear pinions 16 and 17 which are interengaged so that they rotate simultaneously and at the same speed. The shaft 11 is connected directly to a hydraulic motor 18 also fixed to the frame 14. All the hydraulic motors are supplied by a common source 20 of hydraulic fluid under pressure, fixed to the frame 1, through an inlet pipe 22 and an outlet pipe 24. The inlet pipe 22 is connected to the hydraulic motor 18 through a connection 26 which forms a valve and permits isolating the corresponding motor 18 from the common supply source 20.

In a general way, this source 20 is associated with a pump, for example a pump having self-regulating vanes, and is driven by an electric motor and supplies oil through a three-way distributor valve corresponding respectively to forward operation, reverse operation and neutral without pressure, the oil flowing in a closed circuit. A flow regulator with a hydrostatic compensator may also be inserted in the circuit. A throttle may also be provided in the circuit controlling the reverse operation to ensure low speed in this case. These elements are conventional and have not been shown.

The lower shaft 3 of each profiling head 2 carries, between the fixed support 6 and the cardan joint system 10, a notched pulley 28. Extending around the latter are, on one hand, a notched belt 30 for connection with the pulley 28 integral with the shaft 3 of the following head relative to the direction of movement of the metal symbolically represented by the arrow F in FIG. 2 and, on the other hand, a notched belt 31 for connection with the shaft 3 of the preceding profiling head.

Thus the lower shafts of the successive heads are connected in pairs and driven at the same speed. Any accidental braking of one of the rolls or of one of the heads is transmitted to the other heads so that the force is distributed thereamong and no obstacle prevents a uniform distribution of the pressure of the hydraulic fluid in the different motors. This is particularly important upon the first insertion of the metal to be profiled since some profiling heads must resist the reaction of this metal whereas others still rotate freely.

Moreover, if an incident occurs on one of the profiling heads and tends to prevent the displacement of the metal, the resulting force is distributed among the other heads and transmitted to the hydraulic fluid source. It is then easy to regulate the source in such manner that it can furnish a given power and interrupt the supply when an excessive effort is required thereof. In this way, a safety regulation is provided which avoids any breakage or other deterioration of the rolls, the machine stopping automatically when an incident occurs.

On the other hand, the machine can be easily adapted to shapes or section members having various thicknesses or sections, owing to an appropriate regulation of the pressure of the hydraulic fluid source which permits obtaining extremely precise variations in speed. Moreover, when it is desired to reduce the number of profiling heads in operation, it is possible to interrupt the supply of a corresponding number of hydraulic motors 18. Moreover, the removal of the belt 30 or 31 is sufficient to stop the driving of the corresponding profiling head. It is clear that the withdrawal of a single one of these belts is sufficient to isolate a group of profiling heads from the remainder of these heads. Consequently, it is sufficient to displace one of the belts 30 or 31 and close the supply of a certain number of hydraulic motors to reduce the number of driven profiling heads. Such operations for withdrawing or placing in positiion a belt and the closing or opening of the supply of the hydraulic motors can be carried out rapidly and very simply. Consequently, the machine is easily adaptable to various types of shapes.

The hydraulic drive moreover results in silent operation and considerably reduces the risks of wear. The elimination of the risk of deterioration of the rolls is an extremely important economic advantage.

It will be understood that various modifications may be made in the embodiment just described. For example, the upper shaft 4 of each profiling head may also be provided with a notched pulley similar to the pulley 28 so that the upper shafts are also connected in pairs by belts similar to the belts 30 and 31.

Furthermore, the assembly comprising the notched pulleys and notched belts can be replaced by another connecting system which is capable of being disassembled, for example sprockets carried by shafts and interconnected in pairs by chains provided with a link which can be disassembled by a rapidly disconnected connection. In another modification, the driving shafts of the heads carry spur or helical toothed gears which are interconnected to rotate together by a shaft on which there are fixed worms each engaged with a gear.

I claim:

1. A profiling machine employing a cold deformation comprising a succession of heads aligned one behind the other, an individual hydraulic drive motor provided for each head, each head including two superimposed rolls, each roll having a support shaft, one of the support shafts in each head being connected to the corresponding hydraulic drive motor, connecting means for connecting said one support shaft of each of adjacent heads to the corresponding one support shaft of the adjacent head, said connecting means being capable of being disconnected, and a source of fluid under pressure being connected to all said hydraulic motors.

2. A machine as claimed in claim 1, wherein in each head a notched pulley is fixed to rotate with the support shaft connected to the motor, and said connecting means comprises a notched belt engaged with said pulley and with the corresponding pulley of the adjacent head.

3. A machine as claimed in claim 1, comprising pressure-adjusting means for the source of fluid.

4. A machine as claimed in claim 1, wherein in each head said connecting means connects both roll support shafts respectively to the corresponding shafts of each adjacent head.

5. A machine as claimed in claim 1, wherein a supply pipe connects each of the motors to the source of fluid and a disconnectable connector connects each pipe to the corresponding motor.

* * * * *